US010573963B1

(12) United States Patent
Wall et al.

(10) Patent No.: US 10,573,963 B1
(45) Date of Patent: Feb. 25, 2020

(54) ADAPTIVE NULLING METASURFACE RETROFIT

(71) Applicant: HRL Laboratories, LLC, Malibu, CA (US)

(72) Inventors: Walter S. Wall, Santa Monica, CA (US); Amit M. Patel, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 293 days.

(21) Appl. No.: 15/706,100

(22) Filed: Sep. 15, 2017

(51) Int. Cl.
*H01Q 3/26* (2006.01)

(52) U.S. Cl.
CPC ..... *H01Q 3/2617* (2013.01)

(58) Field of Classification Search
CPC ..... H01Q 3/2617; H01Q 3/2611
See application file for complete search history.

(56) References Cited

U.S. PATENT DOCUMENTS 3,768,044 A 10/1973 Henry et al.
4,126,866 A * 11/1978 Pelton ..... H01Q 1/425 343/872
5,652,631 A * 7/1997 Bullen ..... H01Q 1/281 343/753
5,958,557 A * 9/1999 Naor ..... H01Q 1/42 250/515.1
6,028,565 A * 2/2000 Mackenzie ..... H01Q 1/422 343/872
6,473,054 B1 * 10/2002 Lopez ..... H01Q 3/2611 342/375
7,088,308 B2 * 8/2006 Delgado ..... H01Q 1/42 343/770
8,890,765 B1 * 11/2014 Dinh ..... H01Q 3/446 343/872
8,963,774 B1 2/2015 Livadaru et al.
9,972,901 B2 * 5/2018 Lavin ..... H01Q 1/428
10,199,722 B2 * 2/2019 Stratis ..... H01Q 1/42
2004/0008153 A1 * 1/2004 Lamensdorf ..... H01Q 1/362 343/895
2004/0227687 A1 * 11/2004 Delgado ..... H01Q 1/42 343/872

(Continued)

OTHER PUBLICATIONS

U.S. Appl. No. 13/562,492, filed Jul. 31, 2012, Colburn et al.

(Continued)

*Primary Examiner* — Lewis G West
(74) *Attorney, Agent, or Firm* — Ladas & Parry

(57) ABSTRACT

An adaptive detection and nulling system includes an antenna or radio frequency aperture, an electronically tunable radome placed over the antenna or radio frequency aperture, the radome including a plurality of scatterers on a substrate, and one or more tunable reactance elements connecting at least two of the scatterers, a microcontroller coupled to the tunable reactive elements and configured to control the reactance values of the one or more tunable reactance elements, and a sensing circuit coupled to the microcontroller, wherein inputs from the sensing circuit are used by the microcontroller to adaptively determine bias voltages to the one or more tunable reactance elements using characterization data of the radome to control the tunable reactance elements to form one or more nulls in a receive radiation pattern of the antenna.

21 Claims, 10 Drawing Sheets

(56) References Cited

U.S. PATENT DOCUMENTS

| | | | | |
|---|---|---|---|---|
| 2004/0263420 | A1* | 12/2004 | Werner | H01Q 1/38 343/909 |
| 2005/0078048 | A1* | 4/2005 | Delgado | H01Q 1/42 343/872 |
| 2007/0080887 | A1* | 4/2007 | Ho | H01Q 1/247 343/840 |
| 2009/0096857 | A1* | 4/2009 | Frisco | H04B 7/18508 348/14.02 |
| 2009/0195361 | A1* | 8/2009 | Smith | H01Q 3/00 340/10.1 |
| 2010/0284086 | A1* | 11/2010 | Novack | H01Q 1/248 359/580 |
| 2010/0295749 | A1* | 11/2010 | Vanliere | H01Q 1/42 343/872 |
| 2016/0380345 | A1* | 12/2016 | Kolak | H01Q 1/422 343/872 |
| 2017/0133754 | A1* | 5/2017 | Raeker | H04B 5/0081 |
| 2017/0187101 | A1* | 6/2017 | Freeman | H01Q 1/3275 |
| 2018/0115086 | A1* | 4/2018 | Olfert | H01Q 1/125 |

OTHER PUBLICATIONS

U.S. Appl. No. 16/152,341, filed Oct. 4, 2018, Wall.

From U.S. Appl. No. 16/152,341, (filed Oct. 4, 2018, non publication requested), Application and Office Actions.

Lau, et al., "A Planar Reconfigurable Aperture with Lens and Reflectarray Modes of Operation" IEEE Transactions on Microwave Theory and Techniques, vol. 58, No. 12, Dec. 2010, pp. 3547-3555.

Mias, C., "Varactor-tunable frequency selective surface with resistive-lumped-element biasing grids," IEEE Microwave and Wireless Components Letters, vol. 15, No. 9 (Sep. 2005), pp. 570-572.

Mautz, J.R., "Modal Analysis of Loaded N-Port Scatterers," IEEE Transactions on Antennas and Propagation, vol. 21, No. 2, 1973, pp. 188-199.

Sun, C. et al., "Fast Beamforming of Electronically Steerable Parasitic Array Radiator Antennas: Theory and Experiment," IEEE Transactions on Antennas and Propagation, vol. 52, No. 7, Jul. 2004, pp. 1819-1832.

* cited by examiner

ADAPTIVE NULLING METASURFACE RETROFIT

TECHNICAL FIELD

The present disclosure is directed in general to communication and sensing systems that have sensitive receivers and in particular to applications that require antennas, radomes and receivers that need to be resilient to damage or interference by high power sources in the environment.

BACKGROUND

A variety of communication and sensing systems with high sensitivity receivers are known. However, these communication and sensing systems often struggle to operate with high sensitivity and reliability while operating in an environment with high power interferers. One of the goals of this invention is to offer an economical retrofit solution to these communication and sensing systems to null these high power interferers dynamically while maintaining their high sensitivity receiver capabilities and substantially increasing their reliability.

Many critical receivers such as Global Positioning Satellite (GPS) receivers, and radio frequency (RF) communication, radar, satellite communications, electronic surveillance, and many other receivers, operate with high sensitivity to detect and process signals from large distances. However, this inherent sensitivity also makes them less resilient to damage by high power sources in the environment. In the case of military systems, these high power interferers can be jammers or electronic attack platforms intended to deny the mission of one of the aforementioned receivers. For many other applications these interferers are often neighboring or adjacent transmitters such as high power radar systems which are unintentionally transmitting power in the direction of a sensitive receiver. While techniques exist to mitigate this interference, none provide a solution which allows existing sensitive receivers to continue operating while in the presence of an undesired high power interferer.

One of the goals of this invention is to enable a retrofit radome technology which can autonomously blank or null a sector or sectors in the radiation pattern of antennas and apertures connected to a sensitive receiver to deny high power radiation emitted towards these antennas from damaging sensitive electronics in the receiver and thus allow the receiver to continue operating without damage.

Several technologies exist for mitigating high power interference, however none of these can adaptively steer nulls in the radiation pattern of an existing receiver without replacing the existing antenna and do not provide a mechanism for the receiver to continue normal operation at unnulled angles while under the illumination of a high power source. Some of these technologies include the use of a conventional diode limiter which prevents damage to receivers when illuminated by high power radiation sources by shorting the input of the receiver. However, this approach also prevents the receiver from receiving incoming signals while exposed to the external high power source.

Other techniques such as reconfigurable antennas offer low power methods for adaptively steering nulls in the radiation pattern of a receiver to mitigate interference, but these technologies do not have an integrated capability to sense the bearing of incoming high power threats while protecting the receiver at the same time and do not have any tuning mechanism robust enough to null the radiation pattern of the receiver at very high power levels.

Some techniques offer replacement designs requiring a new receiver. One such example is the use of an array of electronically controlled parasitic scatters coupled to a central feed antenna to selectively null different sectors in the radiation pattern of the antenna by switching binary loads on or off at the parasitic scatters. These techniques are not retrofit solutions and do not have any means to identify the bearing of a high power interferer while preventing damage to the receiver connected to the antenna while doing so.

Some techniques try to mitigate the effect of interferers by notching the portion of the frequency spectrum on which the interferer is operating. However, this technology does not provide a means of mitigating interferers which are in-band or operating at the same frequency as the receiver.

Hence there is an urgent need in communication and sensing systems that operate with high sensitivity to develop a radome that can be placed over the existing antennas which can autonomously identify the bearing of a high power threat and subsequently null said threat without replacing the existing antenna. Furthermore, there is an urgent need to dynamically locate the bearing of high power interferers while simultaneously protecting sensitive electronics in the receiver from damage and to place a null in the direction of the interferer, while allowing the receiver to continue operating normally at other angles.

SUMMARY

In a first embodiment disclosed herein, an adaptive detection and nulling system comprises an antenna or radio frequency aperture, an electronically tunable radome placed over the antenna or radio frequency aperture, the radome comprising a plurality of scatterers on a substrate; and one or more tunable reactance elements connecting at least two of the scatterers, a microcontroller coupled to the tunable reactive elements and configured to control the reactance values of the one or more tunable reactance elements, and a sensing circuit coupled to the microcontroller, wherein inputs from the sensing circuit are used by the microcontroller to adaptively determine bias voltages to the one or more tunable reactance elements using characterization data of the radome to control the tunable reactance elements to form one or more nulls in a receive radiation pattern of the antenna.

In another embodiment disclosed herein, an electronically tunable radome comprises a plurality of scatterers on a substrate, one or more tunable reactance elements connecting at least two of the scatterers, and a microcontroller configured to adaptively determine bias voltages to the one or more tunable reactance elements using characterization data of the radome to control the tunable reactance elements, wherein the microcontroller generates different receive radiation patterns to locate a bearing of an interferer and to place a receive null at the bearing of the interferer that the radome is activated to protect.

In yet another embodiment disclosed herein, a method of adaptive nulling comprises providing a plurality of scatterers on a substrate forming a radome, providing one or more reactive elements connecting at least two of the scatterers, placing the radome over an existing antenna, correlating received voltage amplitudes with a known array manifold characterization of the radome to determine a bearing of an interferer, and generating one or more nulls in the direction of the bearing of the interferer by controlling the reactive elements with a microcontroller, wherein the existing antenna is not changed or modified.

Another embodiment of this disclosure provides for an electronically tunable radome comprising, a dielectric substrate, an array of crossed dipoles on the substrate, one or more reactive elements connecting the dipoles and a high power sensing circuit controlling the reactive elements using bias lines, wherein the radome generates different receive radiation patterns to locate a bearing of the interferer and places a null in the direction of the bearing.

A method of adaptive nulling is also disclosed, comprising controlling the reactive elements that connect crossed dipoles mounted on a radome by using biasing circuits, to generate three or more receive radiation patterns using the reactive elements. A correlation between signals received at each of these three patterns and a premeasured array manifold is used to determine the bearing of interferers.

In another embodiment of this invention, an array of electronically controlled crossed dipoles are mounted on a low loss substrate and placed over top of an existing antenna or aperture with or without a material spacer. The gap between each dipole is loaded with a switched reactance bank which is tuned actively by a voltage source controlled by an external microcontroller. Inputs to the microcontroller are sent from a sensing circuit having a limiter and connecting to the parent antenna. When a voltage exceeding a designated threshold is sensed by this sensing circuit, the microcontroller begins a direction finding routing which identifies the bearing of the high power interferer in the environment and then adjusts the loads between each dipole accordingly, to place a null in the pattern of the antenna at the bearing of the interferer. While the microcontroller is determining the bearing of the interferer, the limiting portion of the sensing circuit is active preventing damage to any receivers connected to the antenna. Once the high power interferer has been appropriately nulled, this limiter automatically deactivates allowing the receiver to continue normal operation at all other angles outside of the nulled sector. Switches integrated into the aforementioned reactance bank are realized by high power semiconductor materials such as gallium nitride (GaN) or silicon carbide (SiC) allowing each reactance bank to handle large voltage differentials without failure. Furthermore, the exact reactance combinations required to generate a null in the direction of the high power interferer can be determined offline or in-situ using multi-objective optimization algorithms.

A novel feature of this embodiment of the invention is that it can be retrofitted over the top of existing antennas to autonomously and adaptively null high power interferers in the radiation environment of a receiver. The existing antennas themselves do not need to be changed or modified.

Certain embodiments may provide various technical advantages depending on the implementation. For example, a technical advantage of some embodiments may include the capability to provide an electronically tunable radome without having to change the antenna or other system elements. Other embodiments may provide for adding sensing and processing circuitry between the receiver and the antenna subsystem.

These and other features and advantages will become further apparent from the detailed description and accompanying figures that follow. In the figures and description, numerals indicate the various features, like numerals referring to like features throughout both the drawings and the description.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
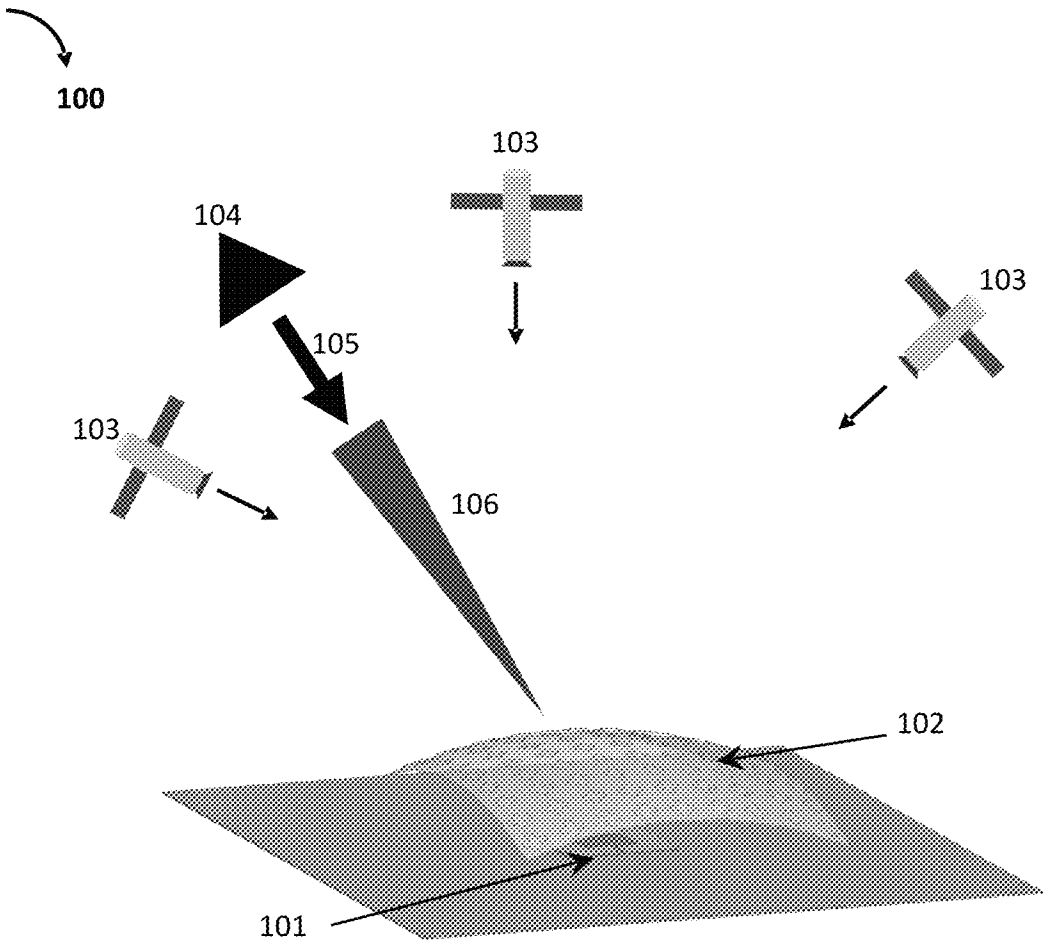
FIG. 1 illustrates a high power adaptive nulling radome retrofitted over an existing antenna, according to an embodiment of the present disclosure.

To overcome the many deficiencies in the prior arts and to meet the urgent needs of communication and sensing systems that operate with high sensitivity, several embodiments of a radome are disclosed which can be placed over existing antennas to autonomously identify the bearing of one or more high power threats and subsequently null said threats without changing or replacing the existing antennas. FIG. 1 illustrates the system 100, which has a radome 102 placed over an existing antenna 101. The radome 102 permits signals from the various communication, sensing, and navigation sources 103, some of which may be very far away, to be received by a highly sensitive receiver attached to the existing antenna 101. For illustrative purposes, a L1 GPS patch antenna is shown in the system 100, though the antenna 101 can be any antenna or aperture. One or more high power interferers 104 may be present in the environment operating at a particular wavelength λ. The existing antenna 101 has a receive radiation pattern. As illustrated, the radome 102 autonomously identifies the bearing 105 of a high power threat 104 and subsequently creates a null 106 in the receive radiation pattern in the direction of the threat 104 at the wavelength of the threat while permitting reception from the various communication sources 103. Thus, the system 100 protects the existing antenna 101 from high power threats at λ without having to retrofit or redesign or change the existing antenna 101. Note that the radome does not transmit a radiation pattern.

Figure 2:
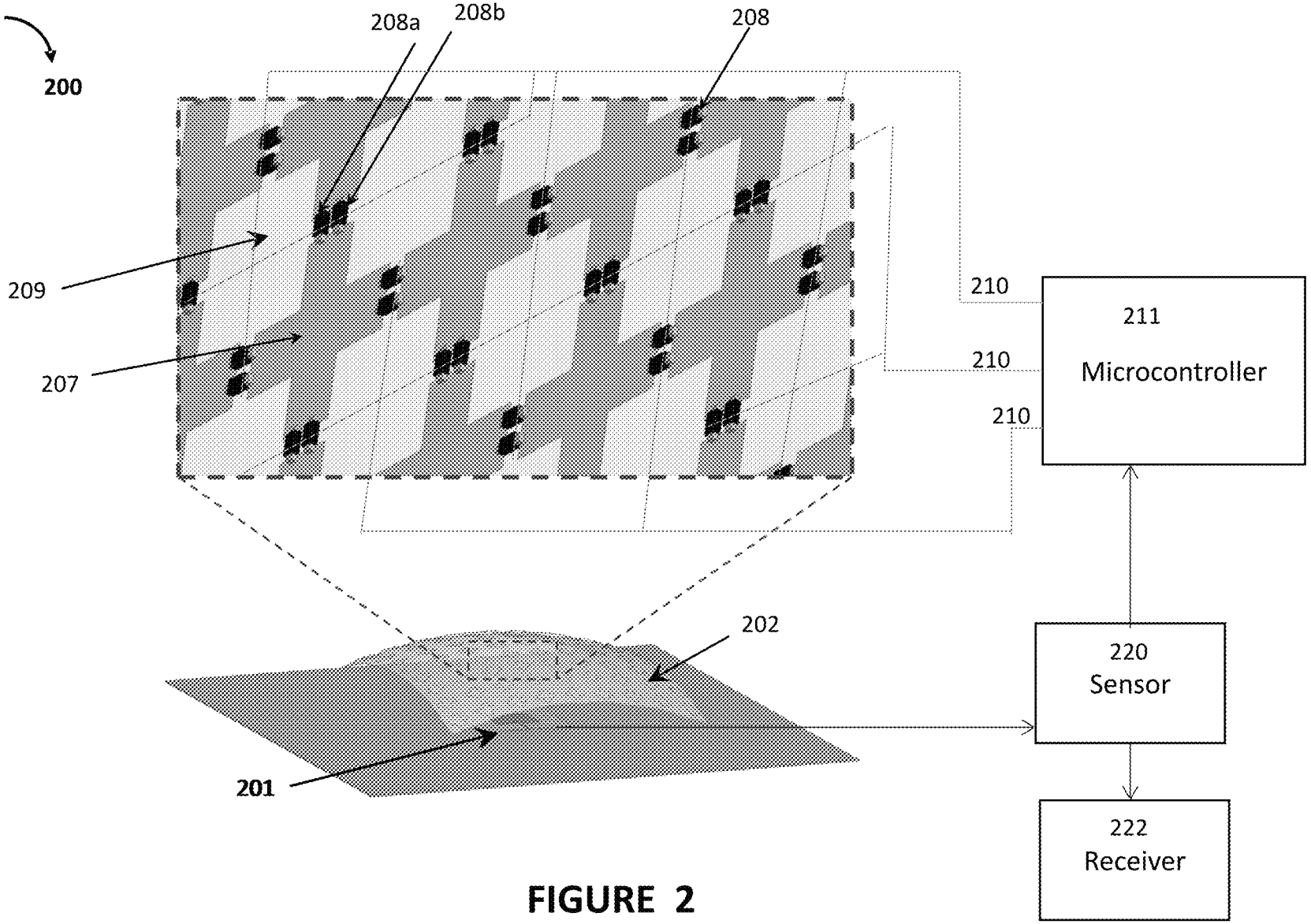
FIG. 2 illustrates a surface integrated reactance banks loading high power adaptive radome, according to an embodiment of the present disclosure.

An exploded view of a high power adaptive radome 202 is illustrated in FIG. 2. In the illustrated embodiment 200 in FIG. 2, an array of electronically controlled small scatterers such as crossed dipoles 207 are mounted on a low loss substrate 209, which may be Rogers R04003, Rogers R03003, or Rogers R05880 material. This radome 202 is placed over an existing antenna or aperture 201. Again, for simplicity, FIG. 2 illustrates a microstrip patch antenna 201, though the antenna can be any antenna or RF aperture. In this embodiment 200, the gap between each dipole or a scatterer 207 is loaded with a switched surface integrated reactance bank (SIRB) 208 which is tuned actively by a voltage source via bias lines 210 and can be controlled by a microcontroller 211. One bias line 210 can control the switches in one reactance bank or a group of reactance banks 208. A reactance bank is any structure that provides a known reactance value or a range of reactance values. A tunable reactance element or a tunable reactive element is a device that allows varying of the reactance values by means such as changing the input bias voltage or by means of other input control signals. Examples of tunable reactance elements are varactors, tunable load banks, tunable capacitor banks etc. Surface integrated reactance banks are semiconductor devices combined with passive components such as resistors, inductors and capacitors. The bias lines 210 may be located on the bottom of the radome 202. The SIRB 208 can be any reactive impedance network or reactance bank or a discrete reactive impedance source. Also, each SIRB 208 can include multiple reactive loads oriented in parallel, such as 208*a* and 208*b* to increase the reactance values. Each SIRB 208 may include switches which may have high power gallium nitride (GaN) or silicon carbide (SiC) transistors. The switches are placed in series with the bias lines 210 to allow each particular SIRB 208 to be switched on or off, such that there is a connection between one scatterer 207 and another scatterer 207, or that the connection between one scatterer 207 and another scatterer 207 is open, respectively. These transistors act as high power switches and allow different loadings to be placed in between the dipoles or scatterers 207 of the array, thus allowing nulls to be formed at different sectors of the radome 202. The mechanism associated with the null forming is explained later with regard to FIG. 8. Voltages are supplied to these reactance banks 208 by either resistively or capacitively loaded bias lines 210 running along the under-side of the radome 202. In some cases, these bias lines may be inductively coupled as well. If these bias lines are loaded with appropriate resistance or capacitance values, their impact on RF propagation through the radome can be minimal. Though FIG. 2 illustrates a periodic spacing of scatterers 207 and SIRBs 208, they can be spaced aperiodically as well.

Figure 3:
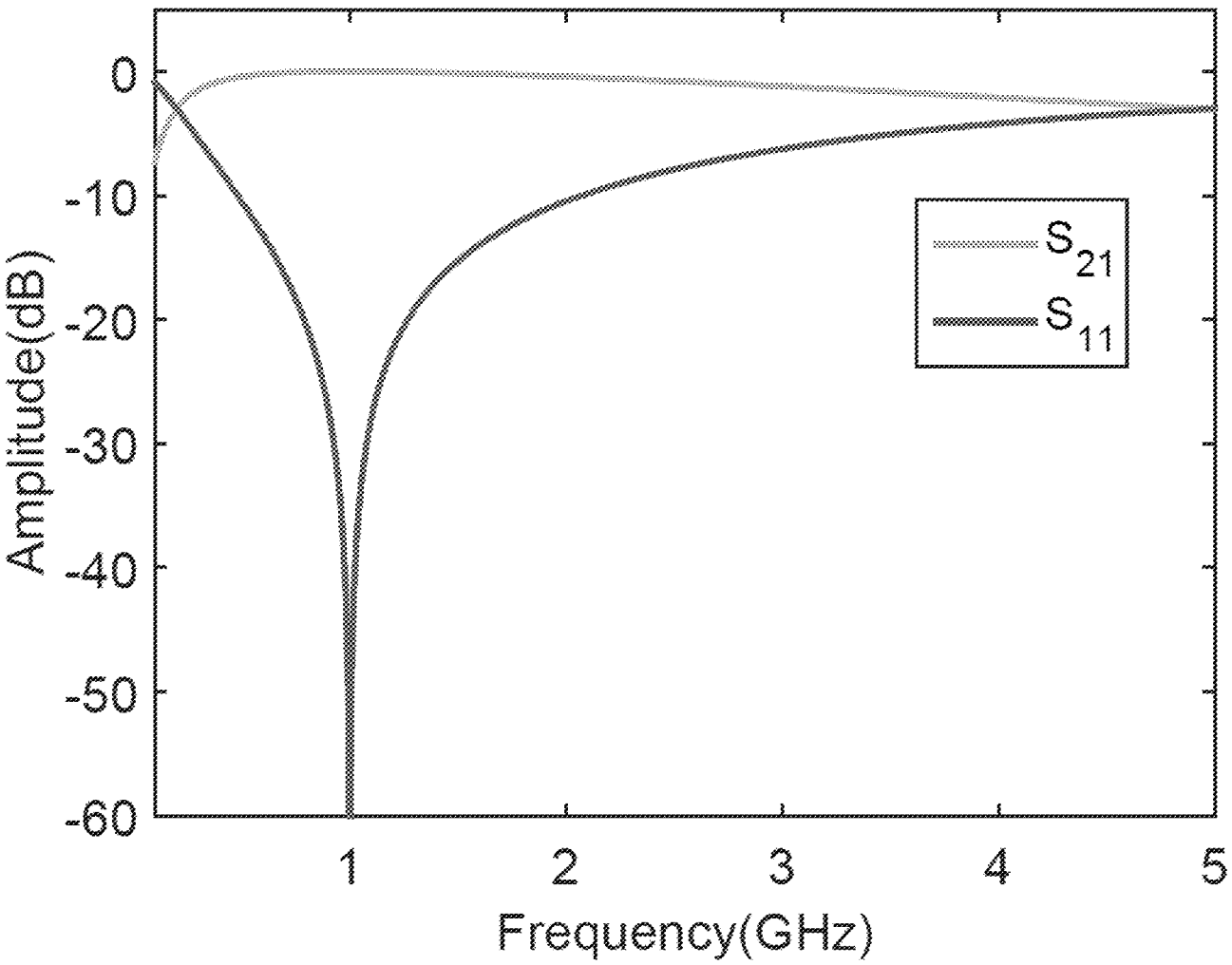
FIG. 3 illustrates transmission and reflection coefficients measured to characterize bias lines loaded with capacitors, for an embodiment of the present disclosure.

As illustrated in FIG. 2, the antenna is connected to a sensor circuit 220, which is connected to the microcontroller 211 and the receiver 222. The operation of the sensor circuit 220 is further described below with reference to FIGS. 6, 7 and 8. The sensor circuit may be on the radome 202 or separate from the radome 202. The effects of the bias lines 210 and the reactance banks 208 on the antenna 201 performance are illustrated in the simulation results of FIG. 3. FIG. 3 is a plot of transmission and reflection coefficients as frequency versus amplitude for a plane wave incident on an infinite periodic array of thin bias lines that are periodically loaded with capacitors along the bias lines. FIG. 3 illustrates simulation results of the predicted transmission ($S_{21}$) and reflection ($S_{11}$) coefficients for a specific embodiment of this invention that uses an infinite periodic array of thin bias lines spaced 3.6 mm apart and loaded with 0.235 pF capacitors in parallel along the length of the bias lines every 29 mm. When bias lines are loaded with parallel capacitive elements as in FIG. 3, the proposed radome also acts as a bandpass filter rejecting out-of-band interference and providing additional electronic protection to the receiver. Because of the small current needed by the switch transistors, controlling the reactance banks with either resistively or capacitively loaded bias lines 210, allows direct current (DC) control signals to be sent to each tunable element 208 in the array, through vias from the bottom of the radome 202 to the top of the radome, while minimizing RF coupling into the bias lines 210.

Figure 4:
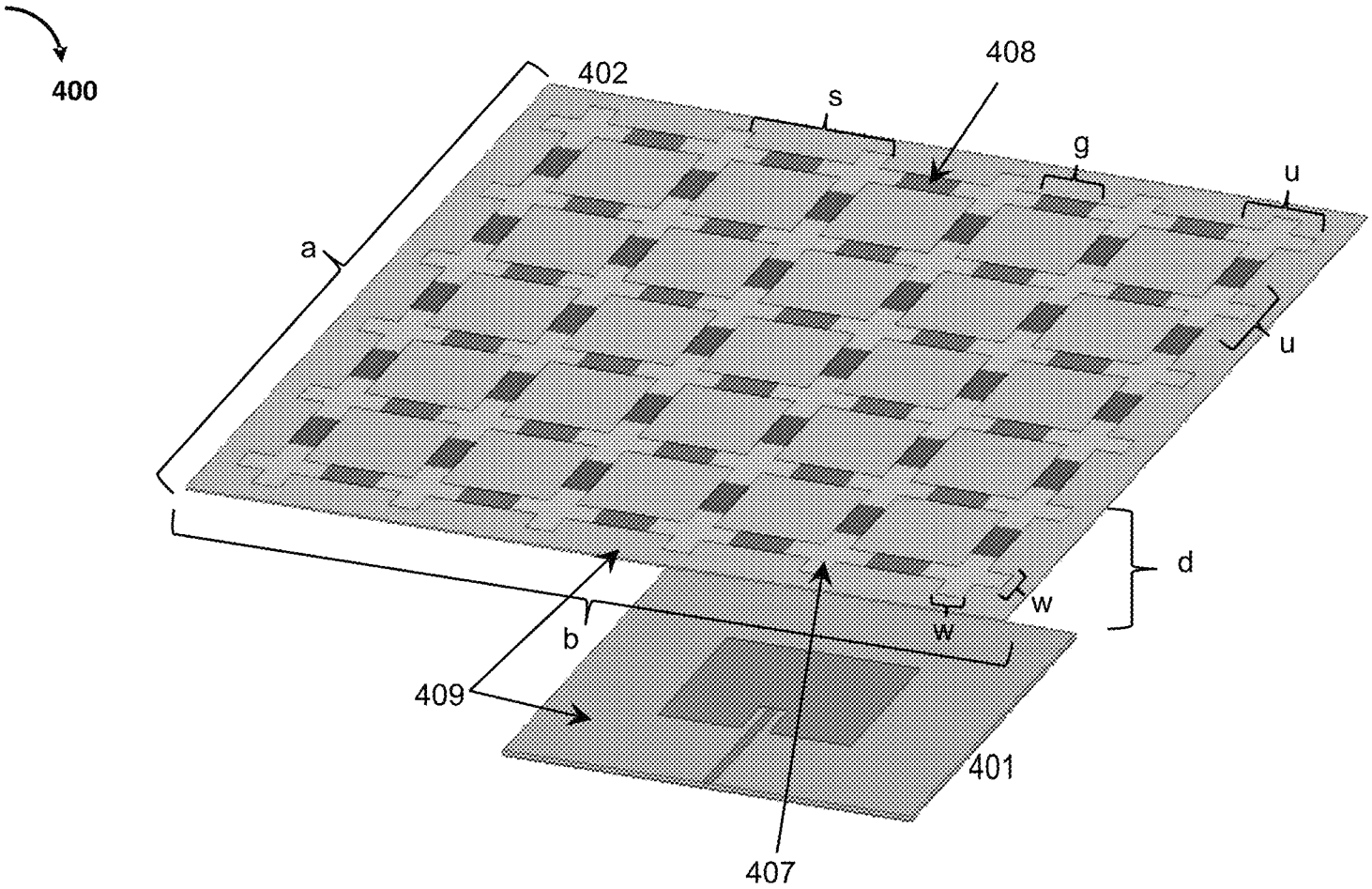
FIG. 4 illustrates an array of discretely tuned crossed dipoles over an antenna, according to an embodiment of the present disclosure.

System 400 in FIG. 4 illustrates an embodiment that has been simulated that demonstrates steering spatial nulls using switched reactive loads. The radome 402 in this embodiment has a 6×6 array of crossed dipoles 407 made of copper strips mounted on a Roger R04003 substrate 409 and placed 36 mm away from a GPS patch antenna 401 tuned to 1.575 GHz. The reactive loads 408 can be of any type as discussed earlier and may have a capacitance in the range of 0.01 pF to about 20 pF. However, for the simulation, reactive load values of 0.2 pF, 0.5 pF, 1.3 pF, 2 pF, and a short were used. The dimensions of this array marked in FIG. 4 are as follows:

a=Board Width=285.75 mm
b=Board Length=285.75 mm
s=Element Spacing=47.625 mm
g=Gap Distance=18.875 mm
u=Unit Cell Size=28.75 mm
w=Trace Width=9.25 mm
d=Radome Spacing=36 mm Though the preferred value of the radome spacing "d" from the antenna is less than or equal to $\lambda/4$, where $\lambda$, is the wavelength of the interferer where the null is being steered, it can be greater than $\lambda/4$ as well. The element spacing "s" can be $\lambda/4$ or less. The elements are typically made with electrical conductors such as copper.

Figure 5:
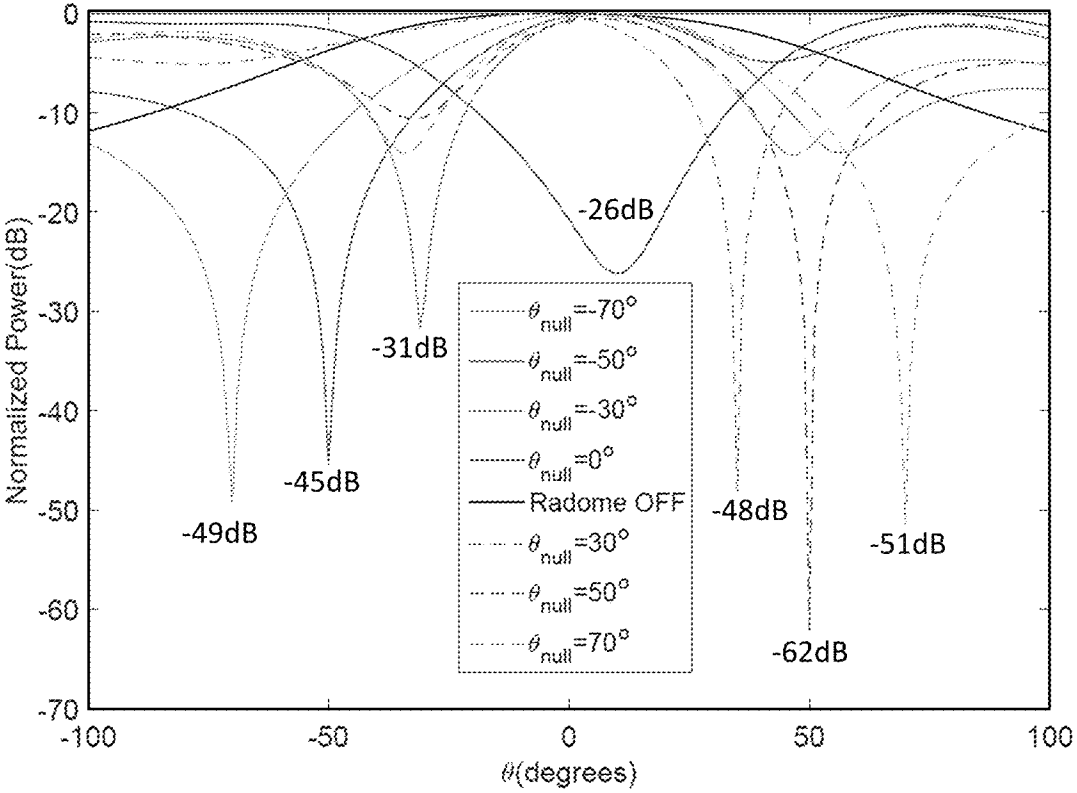
FIG. 5 illustrates a simulated null steering characteristics for the embodiment in FIG. 4, according to an embodiment of the present disclosure.

FIG. 5 illustrates null steering as demonstrated by the simulation of the radome illustrated in FIG. 4 using five arbitrary discrete reactance values of 0.2 pF, 0.5 pF, 1.3 pF, 2 pF, and a short. Reactance elements of the values indicated above are placed between crossed dipoles as indicated in FIG. 2. As illustrated in FIG. 2, reactance values can be changed by adding reactance elements in parallel (like elements 208*a* and 208*b*). Reactance elements can be tuned dynamically via software as well. FIG. 5 is a plot of elevation angle versus normalized power (dB). The spatial nulls were steered to 7 distinct positions in the field of view of the patch antenna ranging from elevation angles of −70° to 70° as illustrated in FIG. 5. The generation of nulls in a given direction and steering of the nulls to several distinct positions are explained in greater detail in FIG. 8. When no voltage via bias lines 210 is applied to tunable elements ('Radome OFF'), the gaps between small scatterers or dipoles are effectively open circuited, generating a broad radiation pattern similar to that of the GPS patch antenna in isolation. Optimum load values for maximizing null depth at each bearing can be determined before installation of the radome using multi-objective optimization algorithms and full wave simulations or measurements. These results are a specific example of the proposed concept and can be generalized to include cases where different values and numbers of loads are used to tune the radome.

Figure 6:
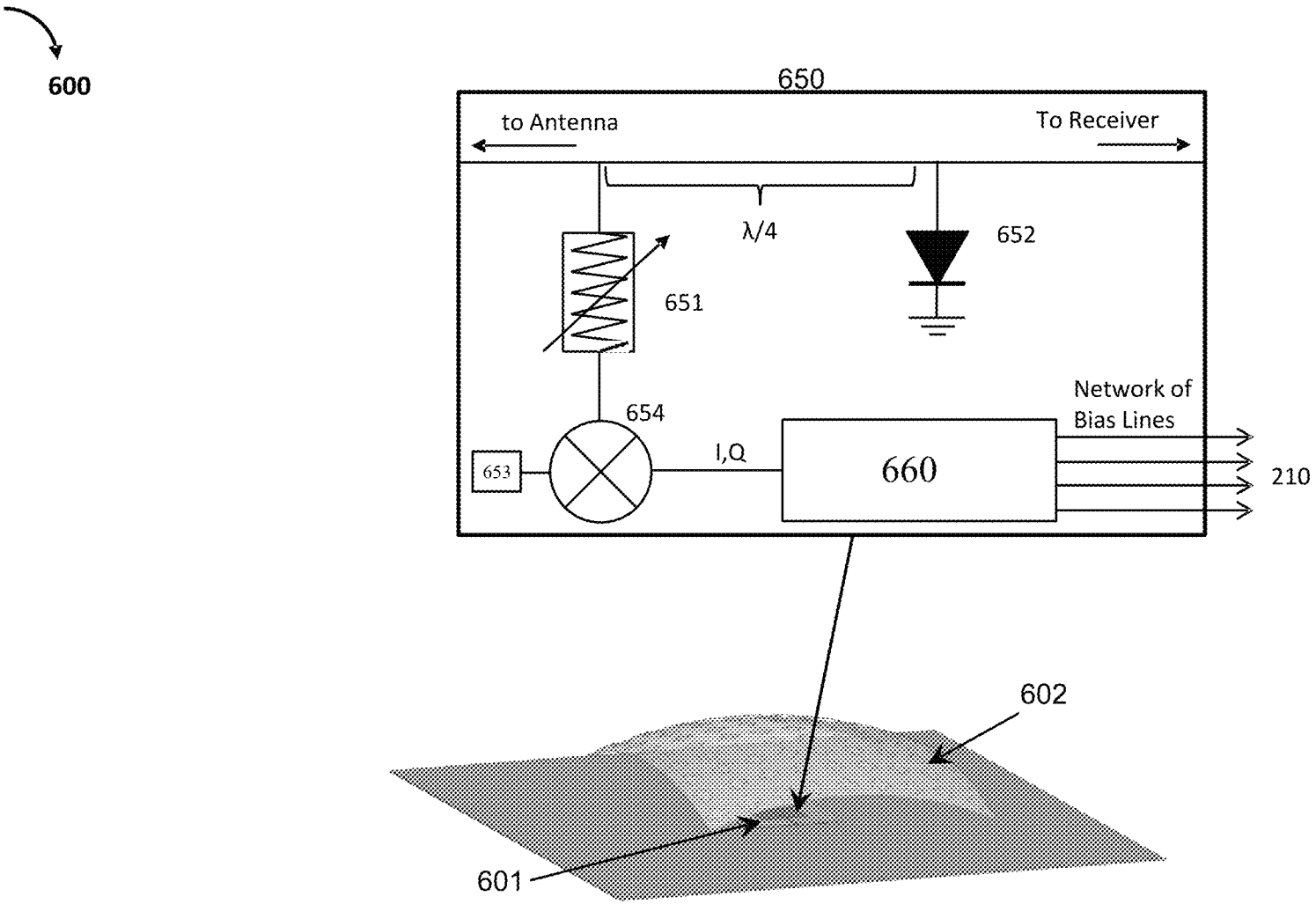
FIG. 6 illustrates a high power sensing and limiting circuit, according to an embodiment of the present disclosure.

To determine the bearing of the high power interferer in the environment and subsequently place a null in the direction of the interference, as illustrated in FIG. 6 for the system 600, a high power sensing circuit 650 is integrated with a conventional PIN diode limiter 652 and placed in-line with the existing antenna 201. The purpose of this combined circuit is two-fold. First, when a voltage exceeding some specified threshold is sensed at the input of the circuit, the limiter 652 temporarily blocks the input to the receiver, protecting the receiver while the bearing of the high power interferer is being determined. Second, once the limiter is active, this circuit provides the in phase and quadrature phase (I&Q) of the inputs to a microcontroller 660 via a mixer 654, local oscillator (LO) 653 and variable attenuator 651, placed a quarter wavelength away from the limiter 652. If the amplitude of these I&Q values exceed a specified threshold, the microcontroller 660 begins an automatic nulling process.

Figure 7:
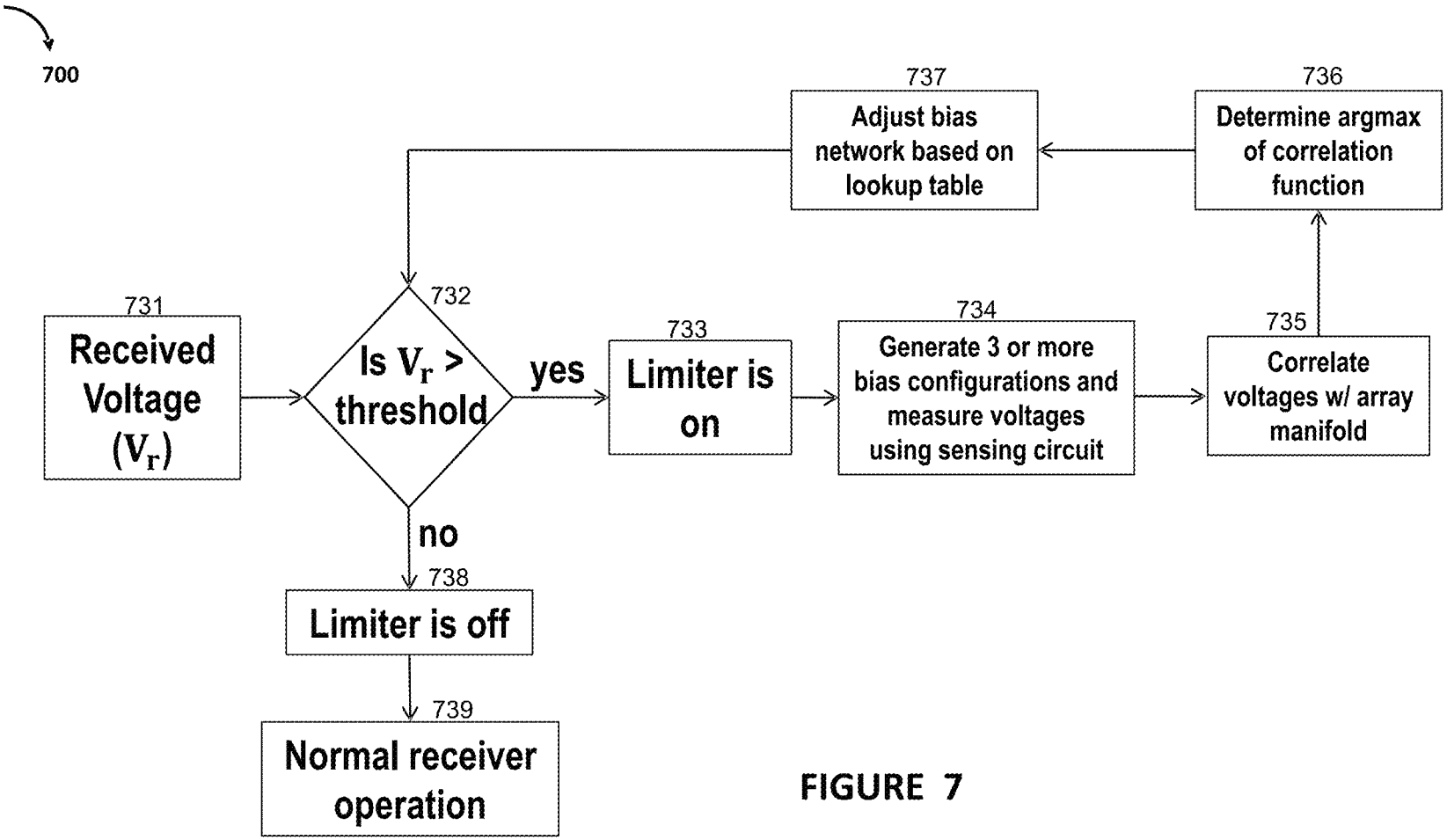
FIG. 7 illustrates an autonomous adaptive nulling algorithm, according to an embodiment of the present disclosure.

The method 700 illustrated via a flow chart in FIG. 7 illustrates an automatic nulling process, according to an embodiment of the present disclosure. The first step 731 in the automatic nulling process is to receive a voltage $V_r$ that represents the magnitude of the incident high power interferer. Then in step 732, this incident voltage $V_r$ is compared with some preset threshold values that will help identify the occurrence of a high-power threat. If in step 732 the incident voltage $V_r$ exceeds the preset threshold value, it turns the limiter on immediately, as shown in the process step 733 to prevent damage to the receiver. If in the step 732 it is determined that the input voltage $V_r$ does not exceed the preset threshold value, then the limiter is turned off as indicated in step 738. In this case, normal receiver operation is continued without any interruption.

If in step 732 a threat is identified and the limiter is turned on, then the process begins to locate the bearings of the incident threat and to create a null in the direction of the threat. This location of the bearings and the subsequent nulling process includes one or more of three distinct steps 734, 735 and 736. First, in step 734, at least three different bias configurations are supplied to the reactance elements of the radome in sequence, generating at least three different receive radiation patterns sequentially. A bias configuration of the radome comprises of a matrix of reactance values of the elements ($a_{11}$ through $a_{MN}$ where there are M rows and N columns of reactance elements in the radome). In a voltage controlled reactance bank, reactance values are changed by changing the voltage applied to the reactance elements. Bias lines in the radome are used to apply these bias voltages to the reactance elements. Each bias configuration is applied one at a time. As bias voltages are applied to the reactance elements in the radome to create each bias configuration, the received I&Q values are measured by sensing circuits 650 and stored by the microcontroller 660, as shown in FIG. 6, when exposed to the interferer. The amplitude $V_1$ is measured from these I and Q values. This is repeated for the three bias configurations with the corresponding set of reactance values and the three sensed voltage amplitudes $V_1$, $V_2$ and $V_3$ are computed. In the second step 735, these measured I&Q values are correlated with a known array manifold to generate a correlation function. The concept of known array manifold is similar to an antenna array characterization. A radome can be characterized for each bias configuration with a known exciter to obtain the calibration data. This calibration data with a known exciter can be used to correlate the detected voltages for each bias configuration. In the step 736, the peak of the correlation "argmax" is detected. The results of the correlation allow the bearing of the interferer to be determined. In the process step 737, a null is generated in the direction of the interferer by reconfiguring the bias line 210 network based on a pre-calibrated and characterized look up table of values.

If there are multiple interferers in the field of view, the highest amplitude interferer is first nullified and the process is repeated to sequentially nullify additional interferers. The reactance bank 208 array can also be subdivided into sub arrays to cover each of the interferers. Additional sensing circuits 650 can be added as needed.

Figure 8:
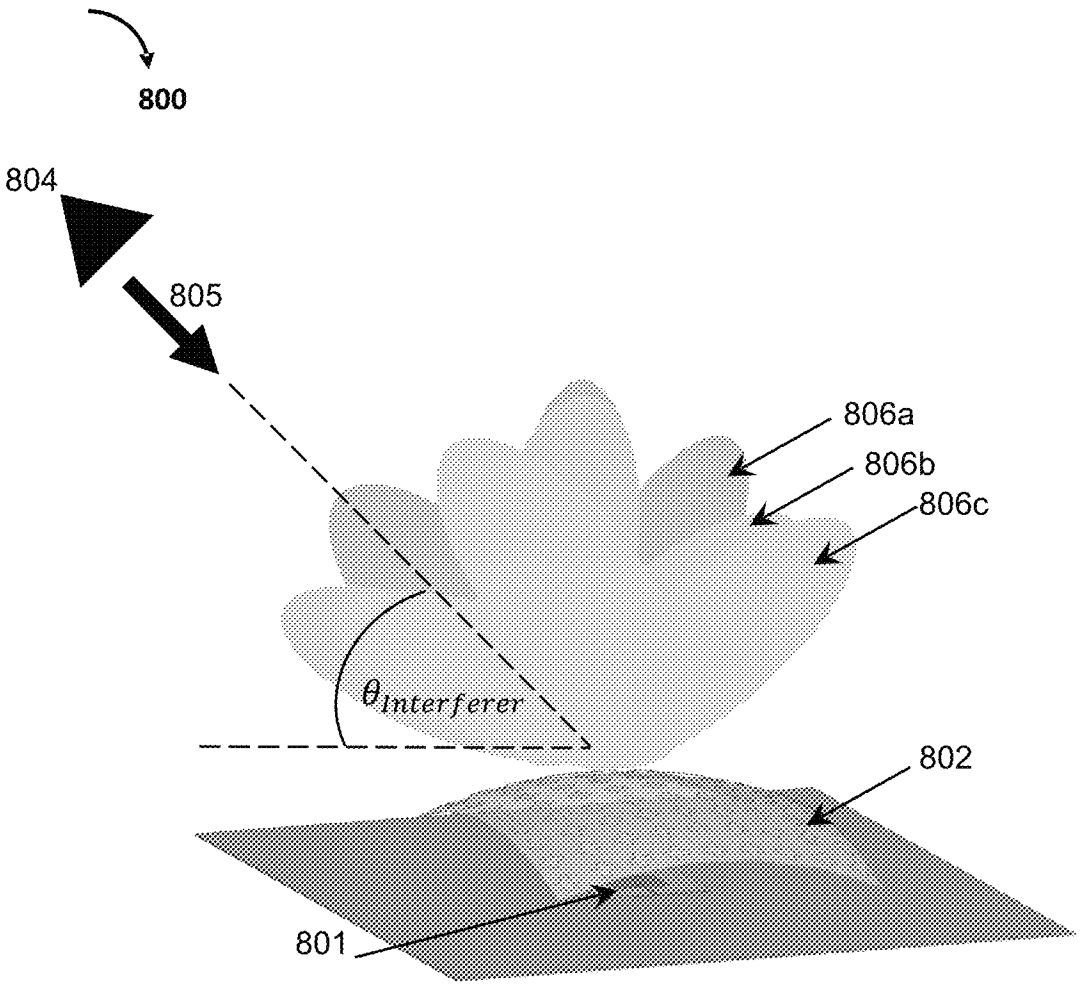
FIG. 8 illustrates a direction finding process using adaptive radome and a high power sensing circuit, according to an embodiment of the present disclosure.
Figure 10:
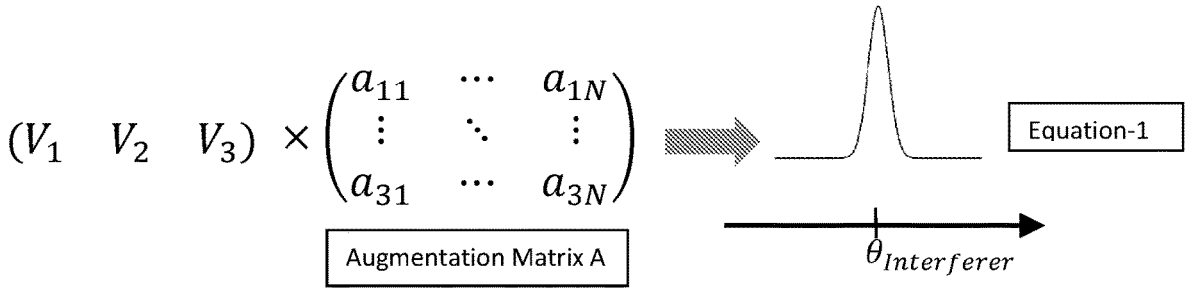
FIG. 10 illustrates corresponding received voltages $V_1$, $V_2$ and $V_3$ correlated with characterized array mainfold data.

The process of detecting the bearings of the interferer and the subsequent nulling is illustrated in system 800 of FIG. 8. In this detection and nulling system 800, a radome 802, an embodiment according to the principles of this invention, is placed over an antenna 801. The three different receive radiation patterns 806*a*, 806*b* and 806*c* are generated by using the three different bias configurations. The corresponding received voltages $V_1$, $V_2$ and $V_3$ are correlated with the characterized array manifold data (the augmentation matrix A) as shown in Equation-1 of FIG. 10.

The location in azimuth and elevation of the peak of this correlation function should correspond to the bearing of the high power threat. Once the bearing 805 is determined, the microcontroller reconfigures the bias voltages supplied to the radome to place a null in the direction of the interferer 804. The exact combination of voltages required to generate a null in a desired direction may be determined before installation using a combination of full wave simulation and measurements. Once a null has been placed in the direction of the interferer the limiting portion of the circuit deactivates automatically and allows the receiver to continue functioning normally at other angles.

The characterization of the proposed radome will help determine the bias voltages required to create the receive patterns that will generate a null in a given direction. The characterization data of the radome is obtained in a two-step test process. The augmentation matrix A, part of the characterization data, is the result of the characterization of the array manifold data. This is the first step in the characterization process. The second step in the test process is the characterization of the bias voltages to yield a specific receive pattern and to measure the received voltages at the various sensor locations in order to create a correlation data table, part of the characterization data of the radome, correlating the bias voltages to the measured sensor voltages. In this illustration, V1, V2 and V3 are measured voltages in the three sensor locations in response to a receive radiation pattern.

To determine the augmentation matrix A, the radome is subjected to a far-field characterization test in an antenna test environment. A known interferer is introduced with a predetermined amplitude and frequency for a given set of bias voltages, the sensors are read out for received voltages. The test is repeated as the location of the interferer is moved around in lateral as well as in azimuth directions. The bias voltages and the amplitude of the interferer are kept the same. The augmentation matrix can be computed with the measured test data.

The second step in the characterization process is to measure the impact of bias voltages on measured sensor voltages for the given radome with a known augmentation matrix from the first step. This test is also carried out in an antenna far-field characterization lab. A known interferer is introduced with a known amplitude and frequency and the sensor voltages are measured for a given set of bias voltages. Without moving the interferer, the bias voltages are changed and the corresponding sensor voltages are measured. Change of bias voltages change the reactance values of the reactance elements in the radome, which in turn changes the sensed voltages. Note that the sensors are located under the radome and are influenced by the reactivity of the radome. The test set can also be repeated for additional locations of the interferer. From this test data, one can create a characterization table that will help determine the range of bias voltages to be applied to the reactance elements in the radome to create corresponding sensor voltages.

Figure 9:
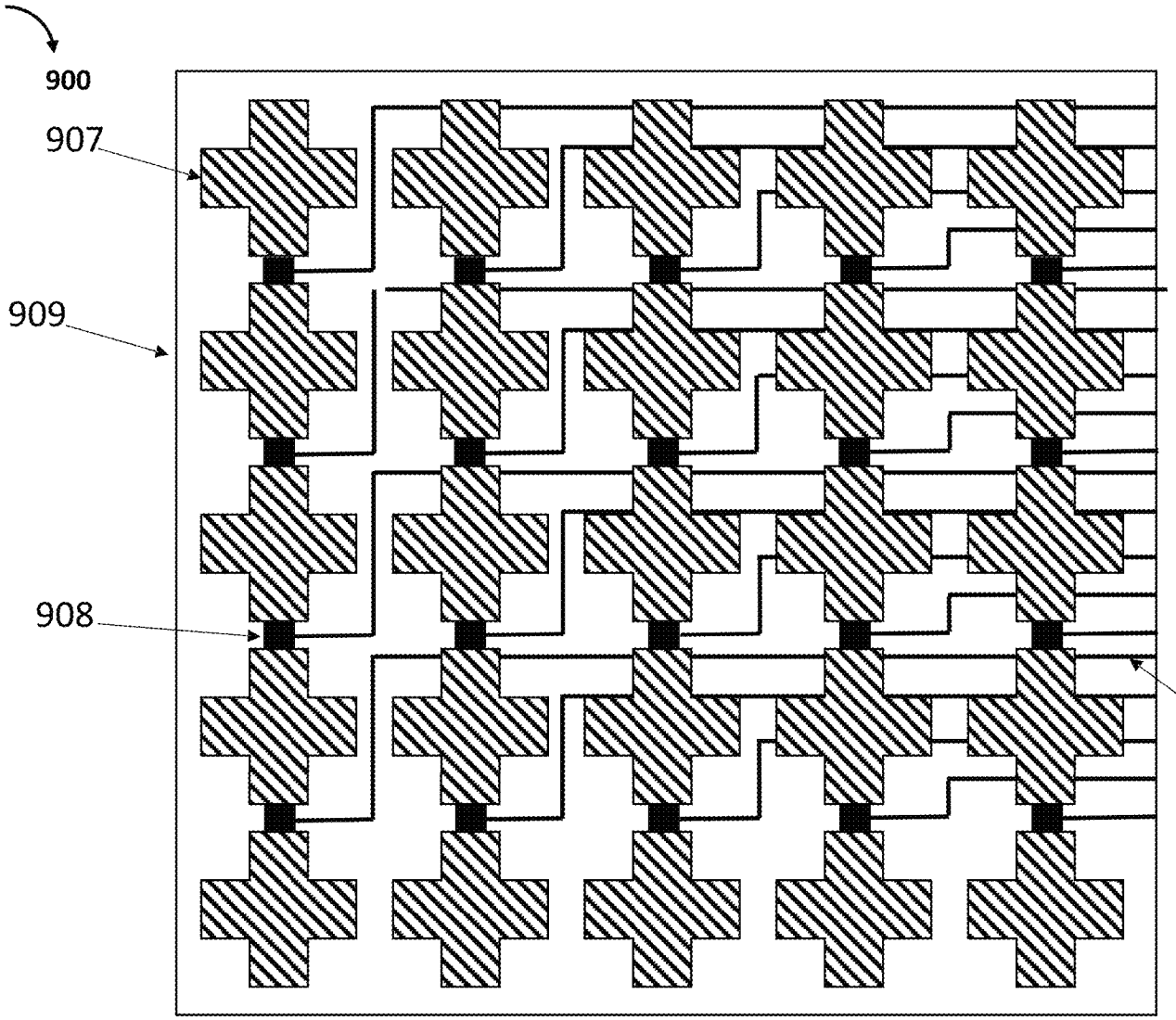
FIG. 9 illustrates a potential arrangement of bias lines, according to an embodiment of the present disclosure.

The inventive concepts described above can be implemented in a variety of ways. The sensor 220 may be as described with reference to FIGS. 6, 7 and 8, or be any sensor circuit and controller that implement the desired adaptive nulling of interferers and protection of receiver 222. The shape and pattern of the scatterers or dipoles can be varied to suit the application needs. The type and location of the reactive elements can be varied as well as their reactive impedance values. The routing and loading of the bias lines can be varied. The location of the sensing circuit can be varied. The sensing circuits and the microprocessor can be built as part of the radome or a circuit that sits in between the antenna and the receiver or located nearby. The number of receive patterns and their shape and orientation can be varied. The type of substrate, the spacing of elements and other parameters illustrated in FIG. 4 can all be varied to suit the application needs. One such variation of the radome is illustrated in FIG. 9. In this embodiment, small scatterers or crossed dipoles 907 are connected in one dimension (top to bottom) using reactance elements 908 on a substrate 909. In this radome 900, there are dedicated bias lines 910 for each reactance elements 908. Many such variations of the radome 900 are possible within the concepts of this invention.

In particular configurations, it may be desirable to have the sensing circuits and bias control circuits be built into the radome. In other configurations, the sensing circuit and the bias control circuits along with a microprocessor can be located on a separate card or unit located nearby or between the antenna and the receiver.

This invention potentially has significant value to various airborne and maritime platforms containing sensitive navigation, communication, and sensing platforms. Furthermore, this invention is useful for traditional RF communication systems of various kinds. Satellite receivers can use this invention to protect their circuits from nearby transmitters.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

What is claimed is:

1. An adaptive detection and nulling system comprising:
- an antenna or radio frequency aperture;
- an electronically tunable radome placed over the antenna or radio frequency aperture, the radome comprising:
  - a plurality of scatterers on a substrate; and
  - one or more tunable reactance elements connecting at least two of the scatterers;
- a microcontroller coupled to the tunable reactive elements and configured to control the reactance values of the one or more tunable reactance elements; and
- a sensing circuit coupled to the microcontroller, wherein inputs from the sensing circuit are used by the microcontroller to adaptively determine bias voltages to the one or more tunable reactance elements using characterization data of the radome to control the tunable reactance elements to form one or more nulls in a receive radiation pattern of the antenna.

2. The adaptive nulling system of claim 1, wherein the microcontroller is located outside the radome.

3. The adaptive nulling system of claim 1, wherein the spacing between two adjacent scatterers is equal to or less than one fourth of a wavelength of interest.

4. The adaptive nulling system of claim 1, wherein the scatterers comprise crossed dipoles.

5. The adaptive nulling system of claim 1, wherein the one or more tunable reactance elements are surface integrated reactance banks.

6. The adaptive nulling system of claim 1, wherein the tunable reactance elements comprise one or more switches, or GaN or SiC transistors.

7. The adaptive nulling system of claim 1, wherein the one or more sensing circuits comprise one or more limiters.

8. The adaptive nulling system of claim 7, wherein the one or more sensing circuits further comprise automatic protection for a receiver from a high power interferer.

9. The adaptive nulling system of claim 1, wherein the one or more sensing circuits comprise one or more microprocessors.

10. The adaptive nulling system of claim 1, wherein the one or more sensing circuits are on the electronically tuned radome.

11. The adaptive nulling system of claim 1:

wherein the antenna or radio frequency aperture is an existing antenna or radio frequency aperture; and wherein the existing antenna or radio frequency aperture is not changed or modified by the radome.

12. The adaptive nulling system of claim 1:

wherein resistively loaded bias lines on the radome connect the microcontroller and the tunable reactance elements; or wherein capacitively loaded bias lines on the radome connect the microcontroller and the tunable reactance elements.

13. An electronically tunable radome comprising:

a plurality of scatterers on a substrate;

one or more tunable reactance elements connecting at least two of the scatterers; and a microcontroller configured to adaptively determine bias voltages to the one or more tunable reactance elements using characterization data of the radome to control the tunable reactance elements, wherein the microcontroller generates different receive radiation patterns to locate a bearing of an interferer and to place a receive null at the bearing of the interferer that the radome is activated to protect.

14. The tunable radome of claim 13, wherein the reactance elements are surface integrated reactance banks.

15. The tunable radome of claim 13, wherein the tunable reactance elements comprise one or more switches, or GaN or SiC transistors.

16. The tunable radome of claim 13 further comprising;

an antenna, wherein the radome is over the antenna;

a receiver;

a sensing circuit coupled to the antenna and the receiver;

wherein the sensing circuit automatically protects the receiver from high power from the interferer; and wherein the sensing circuit provides an input to the microcontroller for controlling the tunable reactance elements to null the interferer.

17. The tunable radome of claim 16:

wherein the antenna is an existing antenna; and wherein the existing antenna is not changed or modified.

18. The tunable radome of claim 13:

wherein resistively loaded bias lines on the radome are coupled between the microcontroller and the tunable reactance elements; or wherein capacitively loaded bias lines on the radome are coupled between the microcontroller and the tunable reactance elements.

19. The adaptive nulling system of claim 13, wherein the spacing between two adjacent scatterers is equal to or less than one fourth of a wavelength of interest.

20. A method of adaptive nulling, comprising:

providing a plurality of scatterers on a substrate forming a radome;

providing one or more reactive elements connecting at least two of the scatterers;

placing the radome over an existing antenna;

correlating received voltage amplitudes with a known array manifold characterization of the radome to determine a bearing of an interferer; and generating one or more nulls in the direction of the bearing of the interferer by controlling the reactive elements with a microcontroller, wherein the existing antenna is not changed or modified.

21. A method for an electronically tunable radome, comprising:

providing a plurality of scatterers on a substrate forming a radome;

providing one or more reactive elements connecting at least two of the scatterers;

correlating received voltage amplitudes with a known array manifold characterization of the radome to determine a bearing of an interferer; and generating one or more nulls in the direction of the bearing of the interferer by controlling the reactive elements with a microcontroller.

* * * * *